US005825721A

United States Patent [19]

Miyane

[11] Patent Number: 5,825,721

[45] Date of Patent: Oct. 20, 1998

[54] TIMEPIECE WITH MUSIC BOX

[75] Inventor: Shinji Miyane, Tokyo, Japan

[73] Assignee: Rhythm Watch Co., Ltd., Tokyo, Japan

[21] Appl. No.: 825,076

[22] Filed: Mar. 27, 1997

[30] Foreign Application Priority Data

Mar. 27, 1997 [JP] Japan ..... 8-071571

[51] Int. Cl.[6] ..... G04B 47/00; G10F 1/06

[52] U.S. Cl. ..... 368/10; 368/272

[58] Field of Search ..... 368/10, 63, 72–75, 368/250, 251, 272–274

[56] References Cited

U.S. PATENT DOCUMENTS

| | | | |
|---|---|---|---|
| 3,875,738 | 4/1975 | Ichikawa et al. | 368/274 |
| 4,349,899 | 9/1982 | Komatsu et al. | 368/273 |
| 4,730,284 | 3/1988 | Adams | 368/272 |

*Primary Examiner*—Vit W. Miska
*Attorney, Agent, or Firm*—Kanesaka & Takeuchi

[57] ABSTRACT

A disc music box (40) is fixed to a slide plate (31), the disc music box (40) is moved together with the slide plate (31) parallel in the plane direction of a disc (61) to enable the pulling of the disc music box (40) out of the timepiece.

3 Claims, 7 Drawing Sheets

TIMEPIECE WITH MUSIC BOX

BACKGROUND OF THE INVENTION

1. Field of the Invention

The invention relates to a timepiece provided with a disc music box to play a melody.

2. Description of the Related Art

Today, there are used many types of timepieces such as a table clock which plays music as the time signal on the hour. Such timepieces are generally equipped with a melody IC to play music or with a music box to play music.

The timepieces having the melody IC as a sound source can have its sound source configured of an integrated circuit and built it therein with ease. Therefore, the melody IC is often built into a timepiece which plays a plurality of music and a compact timepiece, and also used for timepieces having a decorative body which operates with music.

The timepiece having a music box as the sound source can play music with a beautiful tone, and has been often used as a timepiece with music box. And, it is also used as the sound source for a decorative clock which is provided with a decorative body which operates with the time signal.

As FIGS. 5 and 6 show, in recent years, a disc music box 40 using a disc 61 is used as the sound source for timepieces in addition to an ordinary music box which has a conventional rotating barrel to pluck a music box petal.

As FIGS. 5–7 show, this disc music box 40 determines a number by the sheet disc 61 on which a large number of play holes 63 are formed. The disc 61 has on its back a music box petal 43 fixed to a music box body 41, and the music box petal 43 has at its leading end star wheels 45 in the number corresponding to the number of petals of the music box petal 43. And, the disc 61 is held from both sides and rotated by the star wheel 45 and a drive shaft 55 mounted on a disc holding arm 57 which is provided in front of the disc 61.

The star wheel 45 is rotatably mounted coaxially on a wheel shaft 49 in the number corresponding to the number of petals of the music box petal 43, and picks 47 are formed at equal intervals on the periphery of each star wheel 45. The wheel shaft 49 is provided with a drive holder which is directly contacted to the back face of the disc 61 without through the star wheels 45.

Therefore, the revolution of a drive motor 51 fixed to the music box body 41 is transmitted to the drive shaft 55 and the wheel shaft 49 through a reduction mechanism 53 to rotate the drive shaft 55 and the wheel shaft 49 upon which the star wheels 45 and the disc 61 which is held between the drive holder and the drive shaft 55 are started to rotate. When a pick 47 of the star wheel 45 is contacted to the back face of the disc 61 by the rotation of the star wheel 45, the star wheel 45 slips against the rotation of the wheel shaft 49 and stops rotating. Then, the disc 61 is rotated by the rotations of the drive shaft 55 and the wheel shaft 49, the play holes 63 formed on the disc 61 come to the position of the star wheel 45, and the pick 47 of the star wheel 45 is inserted into the play holes 63 to rotate the star wheel 45. At this time, another pick 47 formed on the star wheel 45 lifts up the leading end of the play box petal 43, and when the pick 47 is separated from the music box petal 43 by the rotation of the star wheel 45, the music box petal 43 is sounded in the same way as a conventional barrel type music box.

Thus, this disc music box 40 is provided with the disc 61 and the star wheel 45 instead of the barrel used in the conventional barrel type music box and also has the music box petal 43 as a sounding body, so that music can be played with a clear and beautiful tone. Since the disc 61 is a sheet-like flat plate and rotated to make sound, a suitable pattern is often printed on the surface of the disc 61, the disc 61 is provided below or the like a dial plate 19 of a timepiece 10 as shown in FIG. 5 to produce a decorative effect by the disc 61, thereby enhancing the appearance of the timepiece 10.

There are many types which can lift the disc holding arm 57 upward to enable the removal or replacement of the disc 61 so that a number can be changed. Such a timepiece 10 has an openable front plate 11 as shown in FIG. 7, so that the disc 61 can be changed with the front plate 11 opened.

As described above, the disc music box can play music with a clear and beautiful tone, but since the disc needs a relatively large area, it is hard to make the timepiece compact. To change a number by replacing the discs, it is necessary to provide a space to enable the opening of the front of the disc, and to use the disc music box as the sound source for a timepiece having a decorative body, the position of the decorative body or the provision of the disc music box is limited.

SUMMARY OF THE INVENTION

The present invention provides a slide plate which makes parallel movement in a plane direction and mounts a disc music box on the slide plate, thereby making the parallel movement of the disc music box together with the slide plate in the plane direction of the disc to pull it out of the timepiece.

Thus, when it is made possible to pull the disc music box out of the timepiece, the disc can be changed with ease by pulling out the disc music box.

The slide plate is substantially perpendicular and can be made slidable horizontally or vertically substantially in parallel to the back plate of the timepiece, or the slide plate is almost horizontal and can be made slidable in a direction substantially parallel to the base or the like of the timepiece.

When the slide plate is substantially perpendicular and can be made slidable horizontally or vertically, another decorative body can be provided. And, when the slide plate is substantially horizontal and can be made slidable in a direction substantially parallel to the base plate, another decorative body can be provided above the disc.

DESCRIPTION OF THE PREFERRED EMBODIMENT

Figure 1:
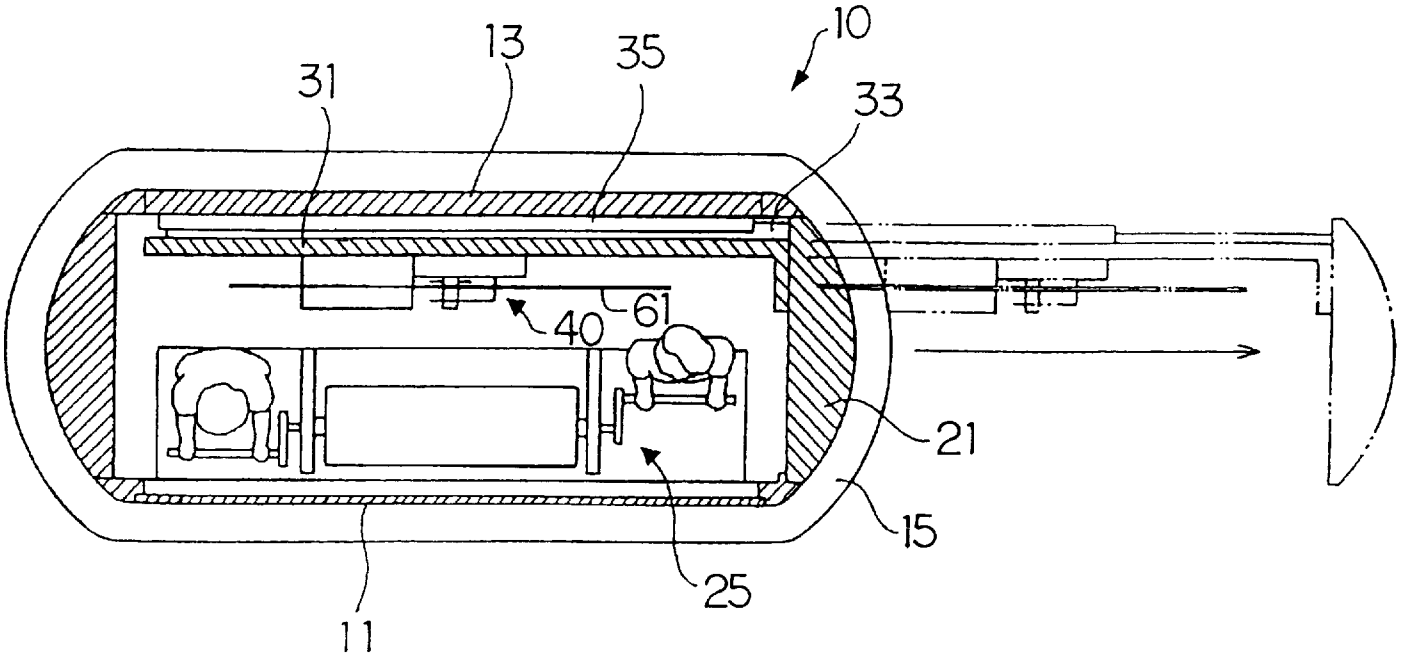
FIG. 1 is a horizontal sectional view of the timepiece with disc music box of the invention.

In FIG. 1, a first embodiment of a timepiece provided with a disc music box according to the present invention has a slide guide rail 35 or a slide rail fixed to a back plate 13 of a timepiece 10. This slide guide rail 35 or the slide rail is fixed with the horizontal direction as an axial direction. And, a slide plate 31 is fixed to a slide rail 33 which slides along the slide guide rail 35 fixed to the back plate 13, and the slide plate 31 which can make parallel movement in the horizontal direction against the back plate 13 of the timepiece 10 is mounted on the timepiece 10.

When the slide rail 33 is fixed to the back plate 13, the slide plate 31 is fixed to the slide guide rail 35. In addition, a side wall plate 21 of the timepiece 10 is fixed to the end portion of the slide plate 31, and the slide plate 31 can be pulled out of the timepiece 10 by pulling the side wall plate 21 with fingers.

The slide rail 33 is made of a two-step slide and can fully pull out the slide plate 31 which is substantially equal to the width of the back plate 13. A disc music box 40 is fixed in front of the slide plate 31 to provide a disc 61 substantially in parallel to the slide plate 31, so that this disc music box 40 is positioned appropriately below the dial plate 19 when the slide plate 31 is housed. Furthermore, another decorative body 25 is provided in front of the disc music box 40.

Thus, the timepiece 10 for this timepiece with disc music box has the slide plate 31 which makes parallel movement along the back plate 13 of the timepiece 10 and the disc music box 40 mounted on the slide plate 31 so as to provide the disc 61 in parallel to the slide plate 31, so that the side wall plate 21 disposed between a base 15 and a top plate 17 can be held to pull out the disc music box 40 sideways from the timepiece 10 to change the disc 61 with ease.

When the disc 61 is pulled out in order to change the disc 61, the disc music box 40 is moved in the plane direction of the disc 61, so that the decorative body 25 is provided in front of the thin disc 61 with respect to the width direction corresponding to the diameter of the disc 61, and the disc music box 40 and the decorative body 25 can be combined easily even when the timepiece 10 is small.

Since this decorative body 25 can be fixed to the timepiece 10, it can be operated with music when a drive mechanism is incorporated appropriately to play music by the disc music box 40. In other words, the disc music box 40 can be moved in parallel to the plane direction of the disc 61 so as to be pulled out of the timepiece 10, so that the disc music box 40 is housed in a thin space to provide a small decorative timepiece, and this decorative timepiece can play beautiful music by changing the disc 61 as desired.

Figure 2:
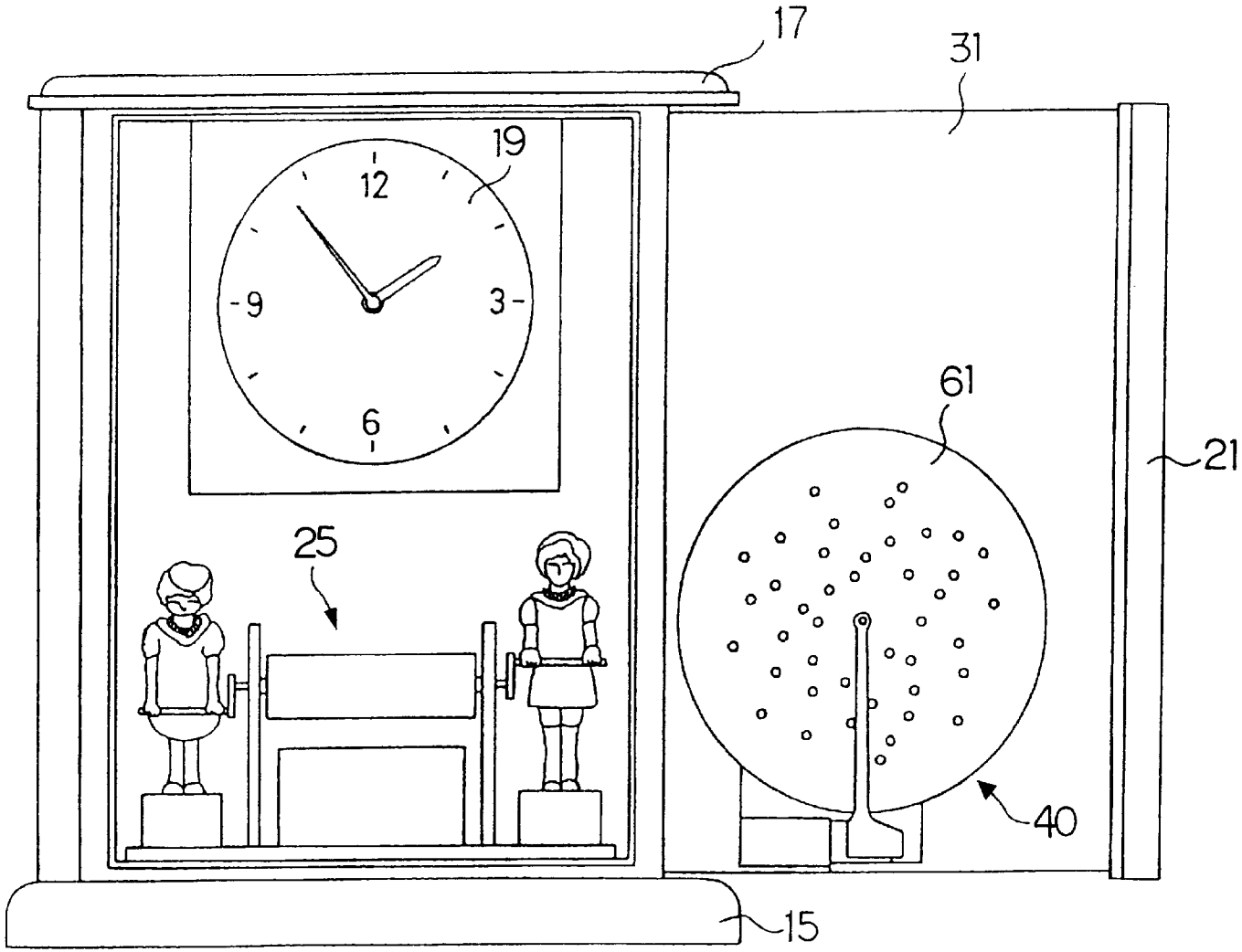
FIG. 2 is a front view of the timepiece with disc music box of the invention.

The timepiece 10 shown in FIGS. 1 and 2 has the side wall plate 21 of the timepiece 10 fixed to the end portion of the slide plate 31 to enable the movement of the entire side wall plate 21, but the lower half portion of the side wall plate 21 may be fixed to the slide plate 31, and the upper half portion of the side wall plate 21 may be fixed to the timepiece 10. Besides, a portion of the lower half and back half part of the side wall plate 21 is fixed as an opening to the slide plate 31, and without limiting to the design of moving the entire side wall plate 21, the opening and the opening and closing section for closing the opening may be formed of the side wall plate 21 corresponding to the shape of the timepiece 10 and the size and storage position of the disc music box 40.

Figure 3:
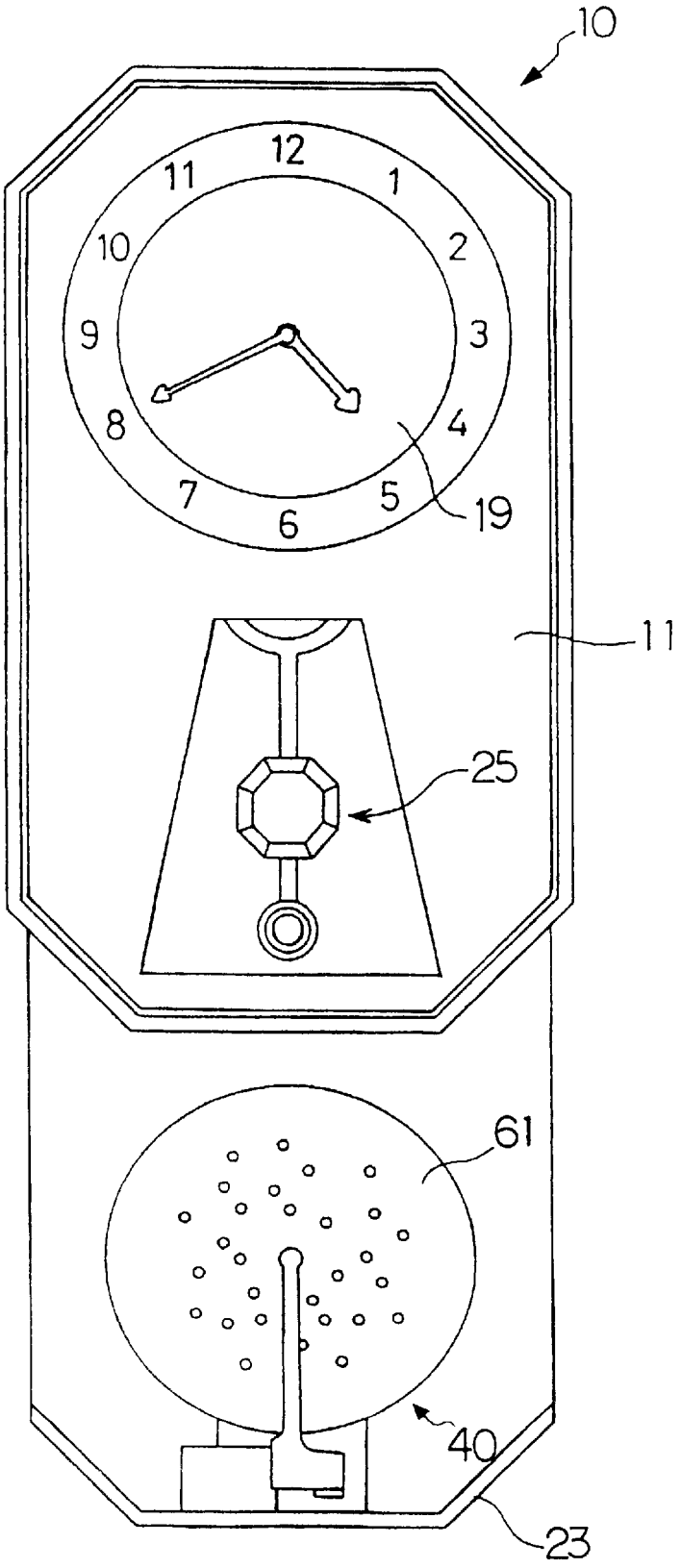
FIG. 3 is a front view showing a second embodiment of the timepiece with disc music box of the invention.

The slide plate 31 is not limited to the pull-out sideways but may be moved parallel vertically with the axial direction of the slide rail 33 designed in the vertical direction. In other words, in addition to the case of providing the axial direction of the slide rail 33 horizontally, for a wall clock, the axial direction of the slide rail 33 or the slide guide rail 35 may be determined vertical and fixed to the back plate 13, and the slide plate 31 is allowed to make parallel movement downward and the disc music box 40 is mounted on the slide plate 31 as shown in FIG. 3.

In such a case, when the lower side wall plate 23 is fixed to the bottom end of the slide plate 31 and the disc music box 40 is housed within the timepiece 10, the bottom end of the timepiece 10 is closed by the lower side wall plate 23. Therefore, in this second embodiment, the decorative body 25 such as a decorative pendulum can be disposed in front of the disc music box 40, the front plate 11 can be opened to adjust the decorative pendulum or the hands, and the disc 61 can be changed easily by pulling down the lower side wall plate 23 to pull out the disc music box 40.

Figure 4:
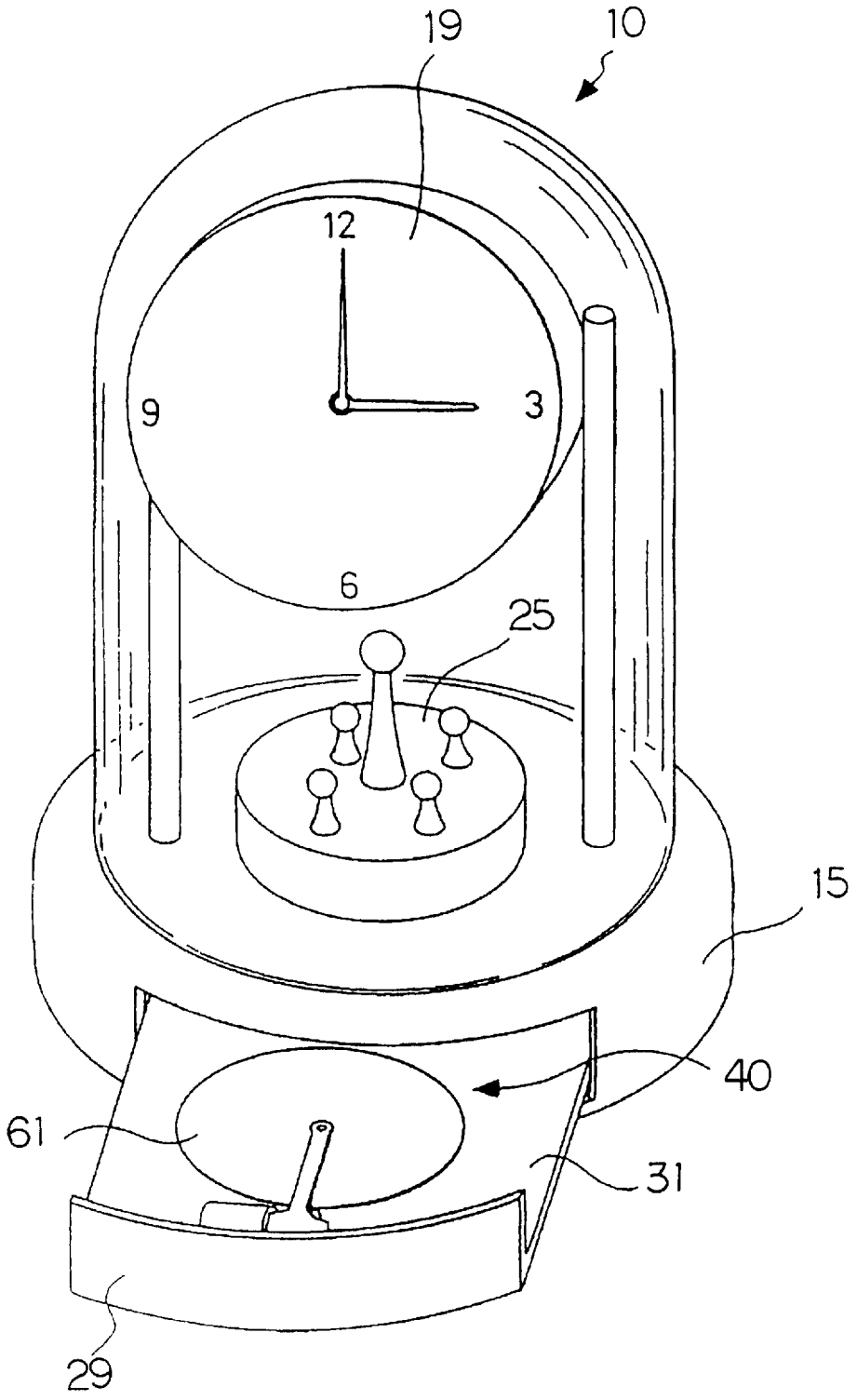
FIG. 4 is a front view showing a third embodiment of the timepiece with disc music box of the invention.
Figure 5:
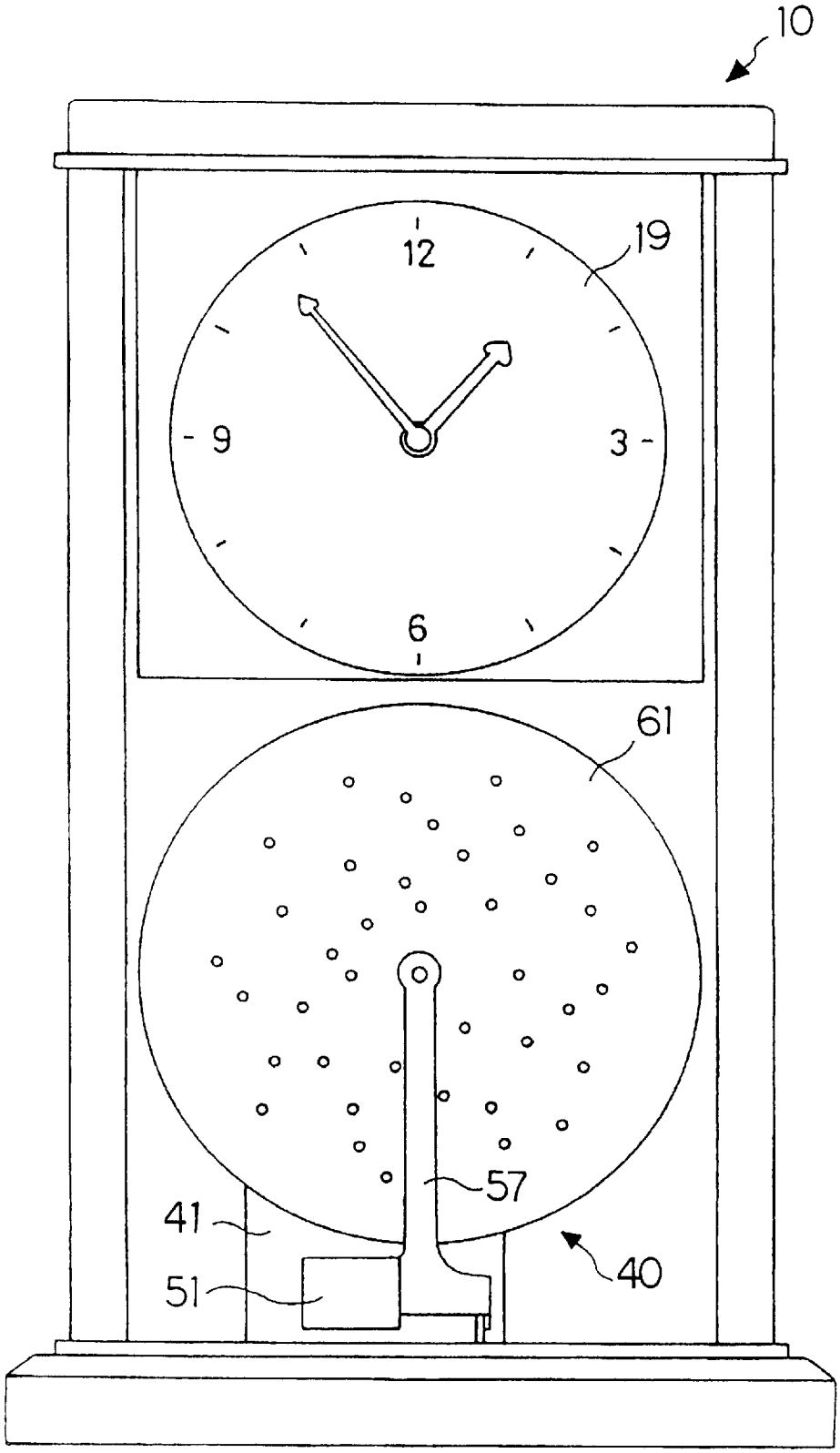
FIG. 5 is a front view showing one embodiment of a conventional timepiece with disc music box.
Figure 6:
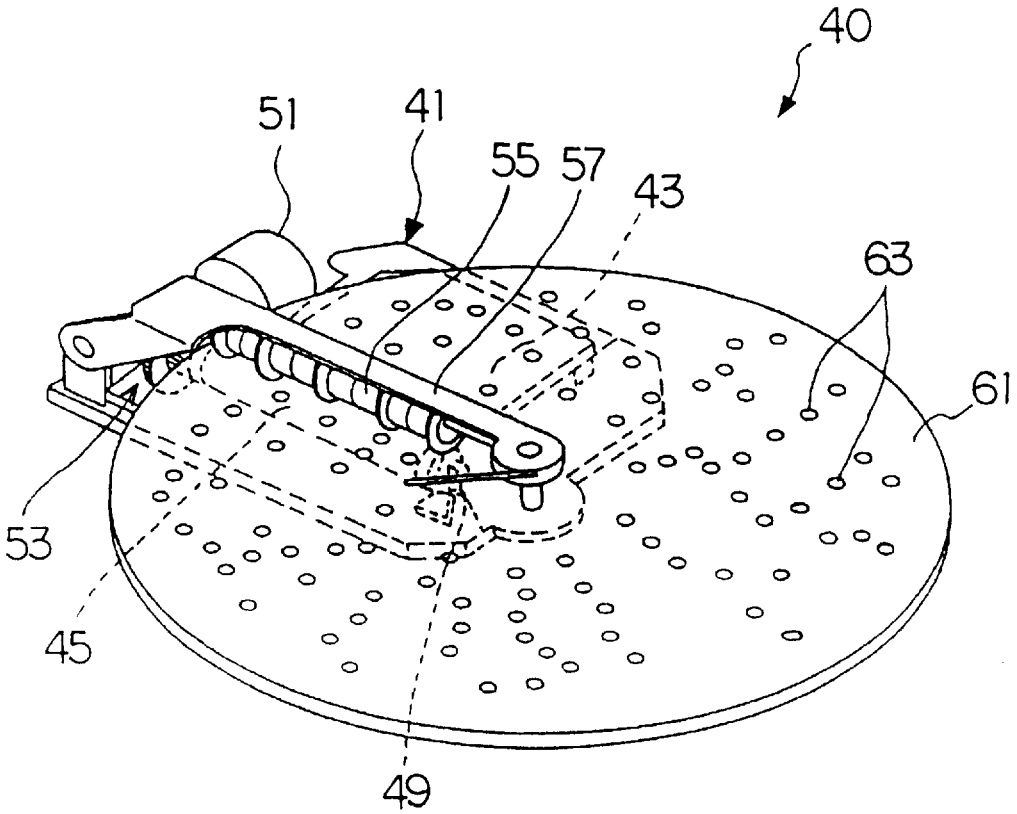
FIG. 6 is a perspective view showing one embodiment of a disc music box.
Figure 7:
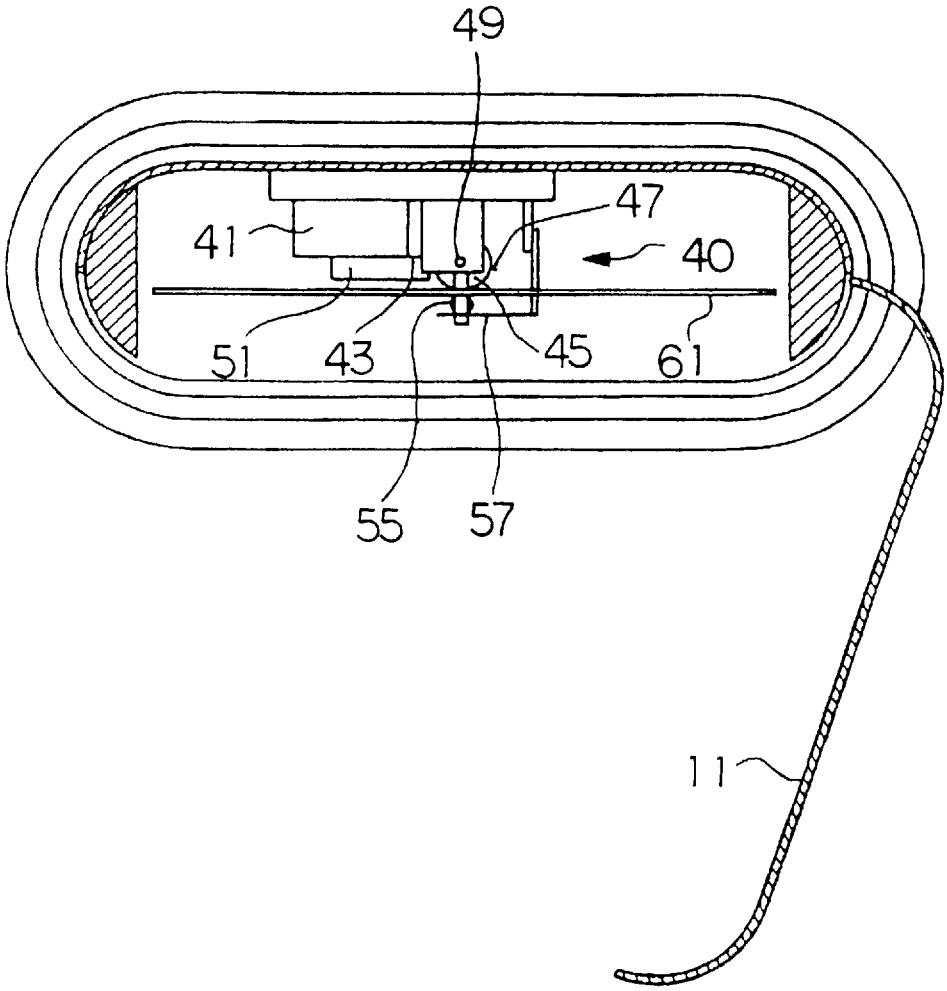
FIG. 7 is a horizontal sectional view of a conventional timepiece with disc music box.

Not only the direct fixing of the slide rail 33 and the slide guide rail 35 to the back plate 13, but also a support member may be provided to move the slide plate 31 substantially parallel to the back plate 13. Besides, as a third embodiment, the timepiece 10 has the disc music box 40 housed within the base 15 as shown in FIG. 4.

In this embodiment, the slide rail or the slide guide rail is fixed to the base 15 or the bottom plate of the timepiece 10 directly or through a support member, the slide plate 31 is provided substantially horizontally, and the slide plate 31 is made movable substantially in parallel to the bottom plate of the timepiece 10 so to be pulled out of the timepiece 10.

In this case, another decorative body 25 can be provided above the disc music box 40 to enhance the appearance of the timepiece 10. And, it is also possible to make the disc music box 40, which is provided substantially horizontally, externally visible, or to house the disc music box 40 within the base 15 so that it is not visible from outside of the timepiece 10.

An opening and closing section 29 which forms a part of the side wall of the base 15 is provided at the front end of the slide plate 31 to close the slide plate 31, namely the opening of the base 15 when the disc music box 40 is housed within the timepiece 10. Thus, the embodiment of the invention can pull the disc music box 40 out of the timepiece 10 by means of the slide plate 31, so that the disc music box 40 can be pulled out of the timepiece 10 to change the disc 61 with ease, and since the disc music box 40 is moved parallel in the plane direction of the disc 61, the space for housing the disc music box 40 is enough in a thin space.

Therefore, in combination with another decorative body 25, a compact timepiece with disc music box having the decorative body 25 can be provided easily. Since the disc music box 40 is pulled out to change the disc 61 with ease, 10 the timepiece with disc music box which can be combined easily with various types of decorative bodies 25 to play a desired number in a clear and beautiful tone.

With the timepiece with disc music box according to the invention, the disc can be changed easily because the disc music box is pulled out of the timepiece, and it is easy to combine with another decorative body since the disc is housed in a thin space. Therefore, the appearance of the compact timepiece with disc music box can be enhanced to provide a timepiece which looks good.

The invention makes it easy to change the disc, provides the decorative body in front of the disc music box, and makes the front appearance of the timepiece good. The invention also provides the decorative body above the disc music box to conceal the disc music box, thereby making the compact decorative timepiece which plays music with a beautiful tone.

What is claimed is:

1. A timepiece with a disc music box comprising:

a slide plate to which the disc music box is fixed, and means for slidably supporting the slide plate in parallel to a direction of a plane of a disc and the slide plate to enable pulling of the disc music box out of the timepiece.

2. A timepiece with a disc music box according to claim 1, wherein said slidably supporting means comprises a back plate of the timepiece.

3. A timepiece with a disc music box according to claim 1, wherein said slidably supporting means comprises a base plate or a base of the timepiece.

* * * * *